US010366676B2

(12) United States Patent
Kim et al.

(10) Patent No.: US 10,366,676 B2
(45) Date of Patent: Jul. 30, 2019

(54) DISPLAY DEVICE

(71) Applicant: LG Display Co., Ltd., Seoul (KR)

(72) Inventors: Dongik Kim, Goyang-si (KR); Joondong Kim, Paju-si (KR); Hunki Shin, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 35 days.

(21) Appl. No.: 15/786,948

(22) Filed: Oct. 18, 2017

(65) Prior Publication Data

US 2018/0144717 A1 May 24, 2018

(30) Foreign Application Priority Data

Nov. 21, 2016 (KR) ..... 10-2016-0155244

(51) Int. Cl.
*G09G 5/10* (2006.01)
*G09G 3/3233* (2016.01)

(52) U.S. Cl.
CPC ..... *G09G 5/10* (2013.01); *G09G 3/3233* (2013.01); *G09G 2300/0439* (2013.01); *G09G 2300/0819* (2013.01); *G09G 2300/0842* (2013.01); *G09G 2310/0202* (2013.01)

(58) Field of Classification Search
CPC ..... G09G 5/10; G09G 3/3233; G09G 2300/0842; G09G 2300/0819; G09G 2310/0202; G09G 2300/0439
See application file for complete search history.

(56) References Cited

U.S. PATENT DOCUMENTS

2007/0273621 A1* 11/2007 Yamashita ..... G09G 3/3233 345/76
2013/0088417 A1 4/2013 Kim et al.

OTHER PUBLICATIONS

Extended European Search Report dated Apr. 17, 2018, issued in corresponding European Patent Application No. 17201528.1.

* cited by examiner

*Primary Examiner* — Amit Chatly
(74) *Attorney, Agent, or Firm* — Morgan, Lewis & Bockius LLP

(57) ABSTRACT

A display device includes a plurality of pixels, and a pixel disposed in a n-th pixel line has a light emitting diode, a driving TFT to control a current flowing the light emitting diode, a capacitor connecting a source of the driving TFT and a gate of the driving TFT, a first TFT controlled by a first gate signal which is transferred through a first gate line to connect the gate of the driving TFT to one of data lines, a second TFT controlled by a second gate signal which is transferred through a second gate line to connect the gate of the driving TFT to an initialization voltage, and a third TFT controlled by the second gate signal transferred to a pixel disposed in a (n−1)-th pixel line to connect the source of the driving TFT to a reference voltage, n being a natural number.

9 Claims, 20 Drawing Sheets

DISPLAY DEVICE

This application claims the benefit of priority under 35 U.S.C. § 119(a) to Korean Patent Application No. 10-2016-0155244 filed on Nov. 21, 2016, which is incorporated by reference herein in its entirety.

BACKGROUND

Technical Field

The present invention relates to a display device and a method of driving the same.

Discussion of the Related Art

An active matrix type organic light emitting display covers an organic light emitting diode (hereinafter, referred to as "OLED") which emits light by itself, and has advantages of a fast response speed, high light emitting efficiency, high brightness, and a wide viewing angle.

An OLED that emits light by itself includes an anode electrode, a cathode electrode, and organic compound layers formed therebetween. The organic compound layers include a hole injection layer HIL, a hole transport layer HTL, an emission layer EML, an electron transport layer ETL, and an electron injection layer EIL. When a driving voltage is applied to the anode electrode and the cathode electrode, holes passing through the HTL and electrons passing through the ETL are transferred to the EML to form excitons. As a result, the light emitting layer EML generates visible light.

In an organic light emitting diode display device, pixels each including an OLED are arranged in a matrix form, and luminance is controlled by controlling the amount of emitted light of the OLED according to the gradation of image data. Each of the pixels includes a driving element, i.e., a driving thin film transistor TFT, which controls the pixel current flowing the OLED according to the voltage applied between its gate electrode and the source electrode. The electrical characteristics of the OLED and the driving TFT deteriorate with time and may cause a difference in the pixels. Electrical deviations between these pixels are a major factor in degrading image quality.

In order to compensate for the electrical characteristic deviation between the pixels, the electrical characteristics of the pixels (the threshold voltage and the electron mobility of the driving TFT) should be compensated. To solve this problem, an internal compensation method for sampling and compensating the threshold voltage and/or the electron mobility of the driving TFT is employed.

When the threshold voltage and the electron mobility of the driving TFT are compensated by the internal compensation method, the gate node and the source node of the driving TFT are initialized and the threshold voltage of the driving TFT is sampled before the data voltage is charged to the pixel, and the electron mobility of the driving TFT is compensated while the data voltage is being charged.

In order to initialize the gate node and the source node of the driving TFT and apply the data voltage to the gate node of the driving TFT, three TFTs and the control signals for controlling the three TFTs are required. There is a problem that it is difficult to raise the aperture ratio of the pixel because three control lines must be connected for each pixel.

When a gate driving circuit is implemented in the form of being embedded in a display panel (the area where the bezel of the display device covers the display panel) together with a pixel array, that is, when implemented as a GIP (Gate In Panel) circuit, the size of the GIP circuit becomes larger and the width of the bezel becomes larger, making it difficult to reduce the width of the bezel.

SUMMARY

Accordingly, embodiments of the present disclosure are directed to a display device that substantially obviates one or more of the problems due to limitations and disadvantages of the related art An object of the present invention is to provide a display device with increased aperture ratio in an organic light emitting pixel employing a driving circuit of an internal compensation type.

Another object of the present invention to provide display device with a reduced number of control lines in an organic light emitting pixel driven by an internal compensation scheme.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel equipped with a plurality of pixels connected with data lines and gate lines; a data driving circuit configured to provide data voltages to the pixels through the data lines; and a gate driving circuit configured to drive the gate lines, wherein a first pixel disposed in n-th pixel line among the plurality of pixels, n being a natural number, may comprise: a light emitting diode; a driving TFT, whose source is connected to the light emitting diode, configured to control a current flowing the light emitting diode; a capacitor connecting the source of the driving TFT and a gate of the driving TFT; a first TFT configured to be controlled by a first gate signal which is transferred through a first gate line and generated by the gate driving circuit to connect the gate of the driving TFT to one of the data lines; a second TFT configured to be controlled by a second gate signal which is transferred through a second gate line and generated by the gate driving circuit to connect the gate of the driving TFT to an initialization voltage; and a third TFT configured to be controlled by the second gate signal transferred to a second pixel disposed in (n−1)-th pixel line to connect the source of the driving TFT to a reference voltage.

In an embodiment, the second gate signal transferred to the second pixel in the (n−1)-th pixel line and the second gate signal transferred to the first pixel in the n-th pixel line may be overlapped with each other for a part of an on-level pulses of turning on a TFT.

In an embodiment, the gate driving circuit is configured to output the on-level pulse having 2 horizontal periods to the second gate line as the second gate signal.

In an embodiment, the gate driving circuit is configured to output the on-level pulse to the second gate line of the first pixel in the n-th pixel line as the second gate signal, and then after a predetermined period of time has elapsed the gate driving circuit is configured to output the on-level pulse having one horizontal period to the first gate line of the first pixel in the n-th pixel line as the first gate signal and the data driving circuit is configured to apply the data voltage to the data line in synchronization with the first gate signal.

In an embodiment, the reference voltage may be lower than the initialization voltage enough to turn on the driving TFT and lower than a voltage that turns on the light emitting diode.

In another aspect, a method of driving a display device, wherein the display device includes a plurality of pixels each of which includes a light emitting diode, a driving TFT whose source is connected to the light emitting diode, a capacitor connecting the source of the driving TFT and a gate of the driving TFT, a first TFT to connect the gate of the driving TFT to one of data lines, a second TFT to connect the gate of the driving TFT to an initialization voltage, and a third TFT to connect the source of the driving TFT to a reference voltage, comprises: generating a first initialization signal having an on-level pulse which turns on a TFT and applying the first initialization signal to a gate of the second TFT of a first pixel disposed in a (n−1)-th pixel line and a gate of the third TFT of a second pixel disposed in a n-th pixel line, n being a natural number; generating a second initialization signal having the on-level pulse and applying the second initialization signal to a gate of the second TFT of the first pixel and a gate of the third TFT of a third pixel disposed in a (n+1)-th pixel line; and generating and applying a scan signal having the on-level pulse to a gate of the first TFT of the second pixel and applying a data voltage for the second pixel to the data line.

In an embodiment, the first and second initialization signals may be overlapped with each other for a part of the on-level pulses.

In an embodiment, the on-level pulses of the first and second initialization signals may have 2 horizontal periods.

In an embodiment, the pulse of the second initialization signal may be generated, and then after a predetermined period of time has elapsed a pulse of a scan signal having one horizontal period may be generated.

Therefore, even if the number of control lines is reduced in the internal compensation circuit for compensating the driving characteristics of the organic light emitting pixels, the compensation performance can be sufficiently ensured and the display quality can be maintained.

And, the aperture ratio of an organic light emitting pixel can be improved while compensating the driving characteristics of the pixel internally.

And, it is possible to reduce the number of control lines that supply control signals along the pixel lines, thereby improving the yield when fabricating the display device.

In addition, it is possible to improve the display quality by making the intervals of the light emitting portions of the organic light emitting pixels constant.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
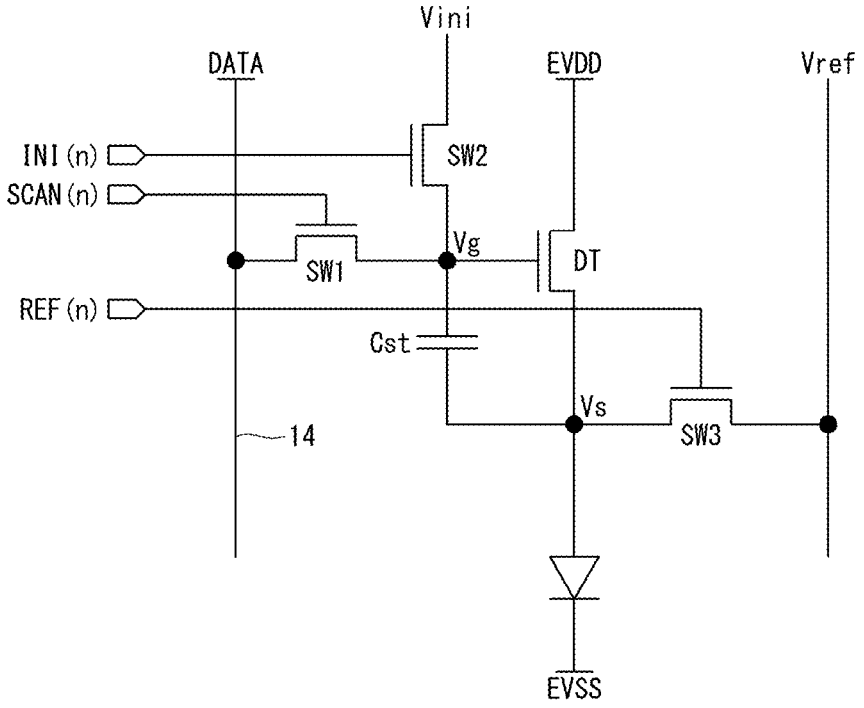
FIG. 1 shows a driving circuit of an organic light emitting pixel composed of four TFTs and one capacitor.

Hereinafter, preferred embodiments of the present invention will be described in detail with reference to the accompanying drawings. Same reference numerals throughout the specification denote substantially identical components. In the following description, a detailed description of known functions and configurations incorporated herein will be omitted when it may make the subject matter of the present invention rather unclear.

Figure 2:
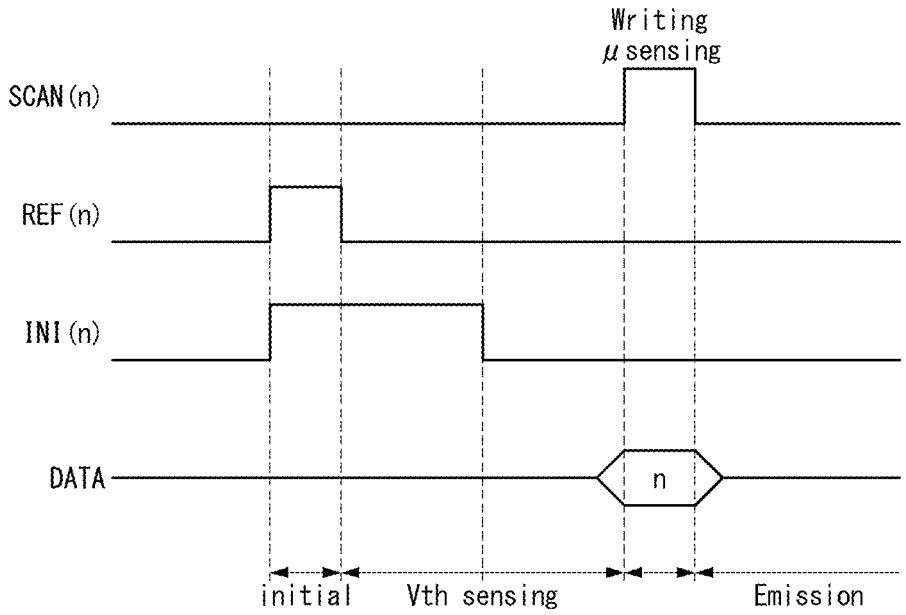
FIG. 2 shows waveforms and timings of control signals for operating the driving circuit of FIG. 1, FIGS. 3A to 3E respectively show the operations of the driving circuit of FIG. 1 during the corresponding periods in the timings of FIG. 2.
Figure 3A:
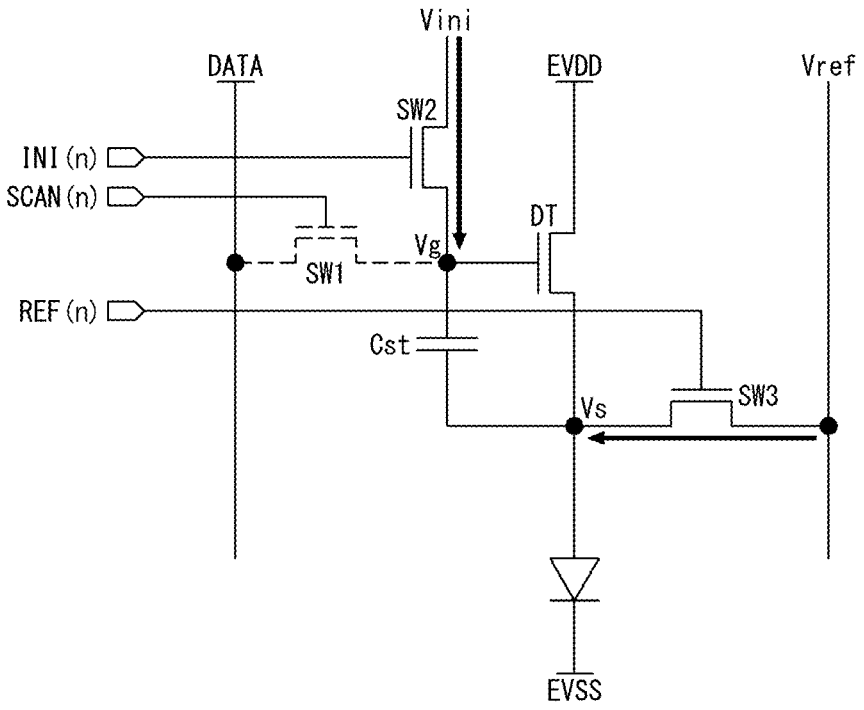
Figure 3B:
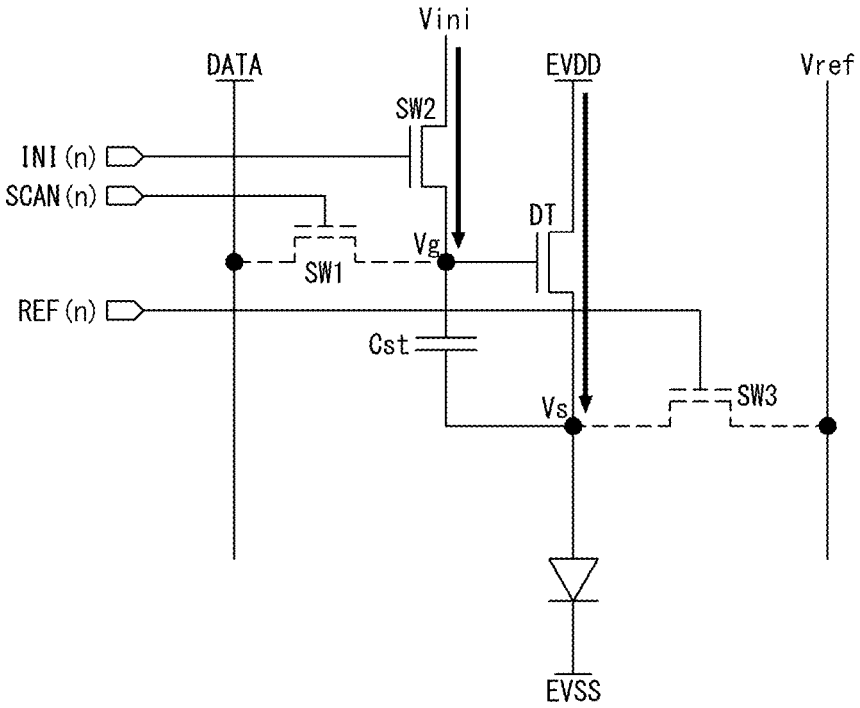
Figure 3C:
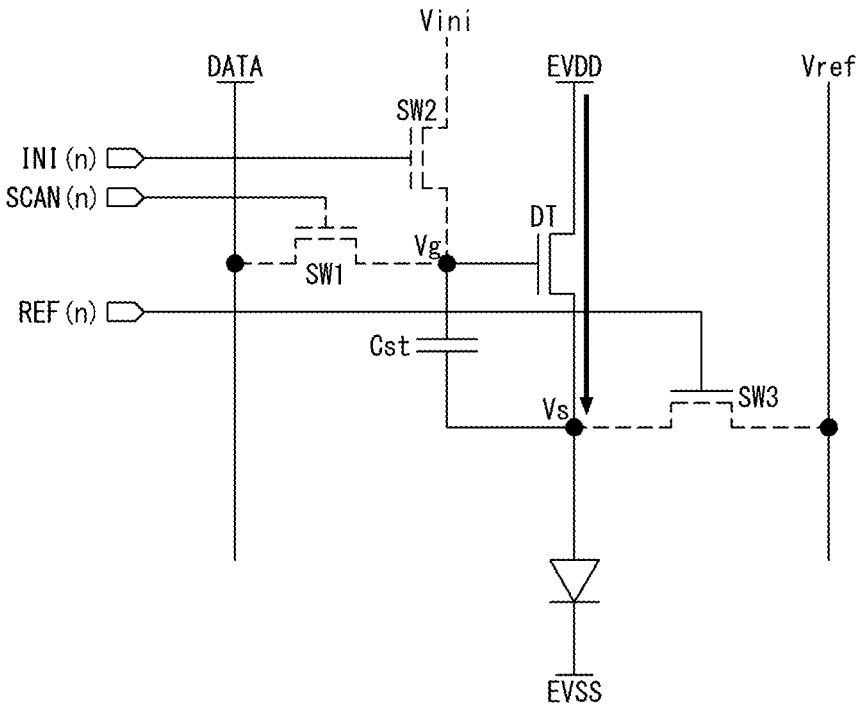
Figure 3D:
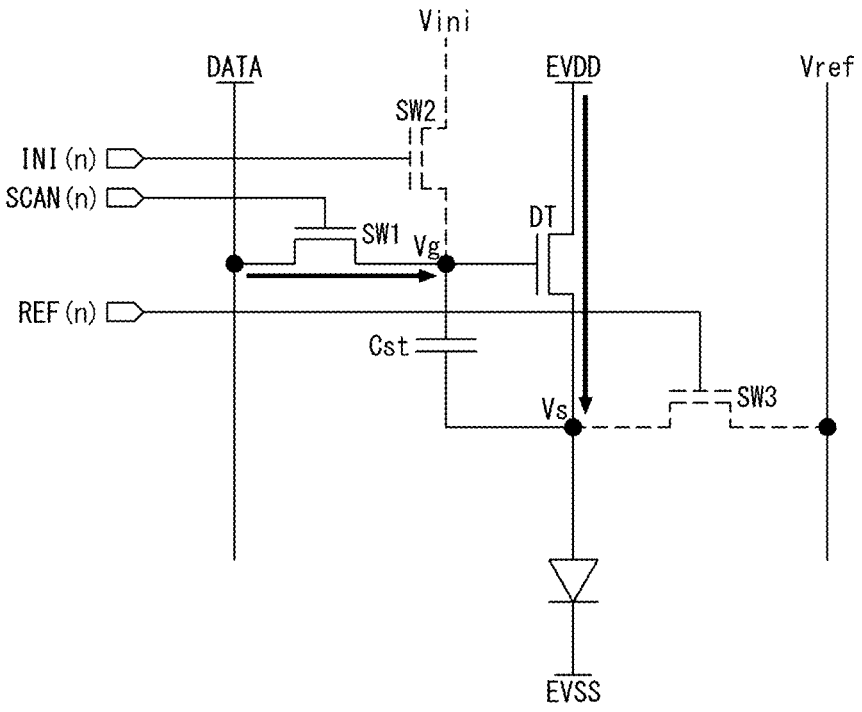
Figure 3E:
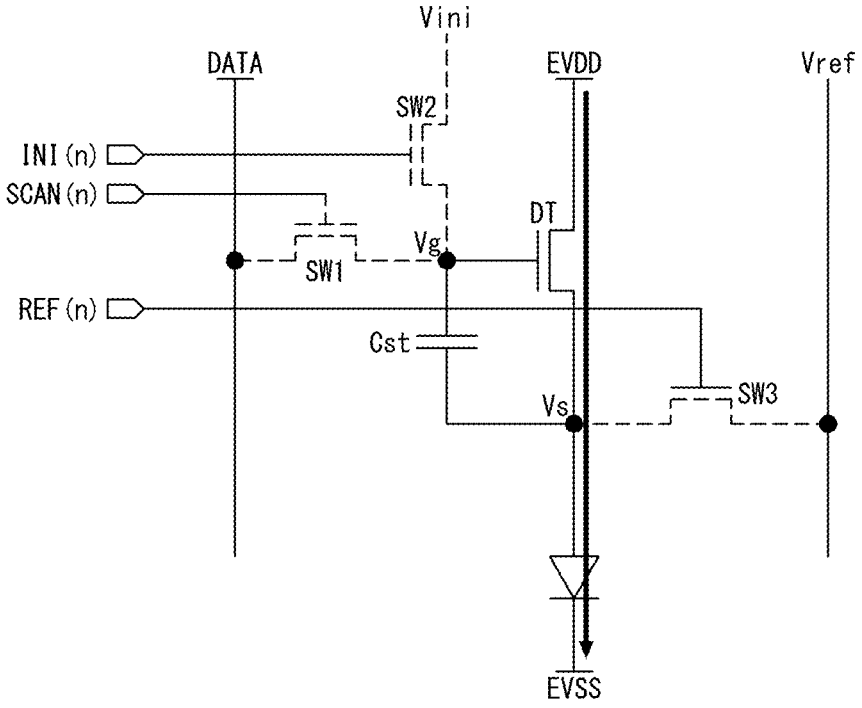
Figure 4:
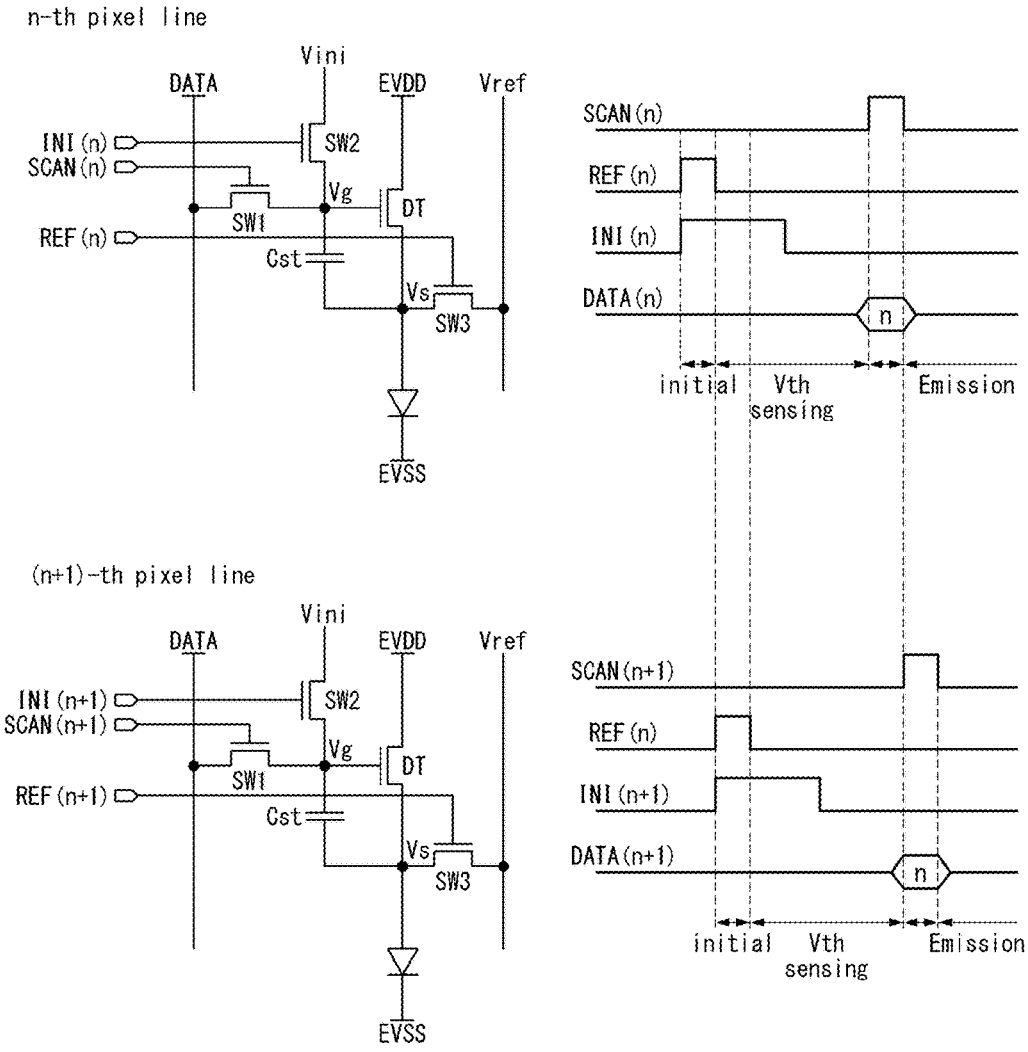
FIG. 4 shows the driving circuits and control signals of two consecutive pixel lines.

FIG. 1 shows a driving circuit of an organic light emitting pixel composed of four TFTs and one capacitor, FIG. 2 shows waveforms and timings of control signals for operating the driving circuit of FIG. 1, FIGS. 3A to 3E respectively show the operations of the driving circuit of FIG. 1 during the corresponding periods in the timings of FIG. 2, and FIG. 4 shows driving circuits and control signals of two consecutive pixel lines In FIG. 1, the pixel (pixel in a n-th pixel line) including the driving circuit for compensating the threshold voltage and the electron mobility of a driving TFT comprises a light emitting diode, a driving TFT DT, a storage capacitor Cst, a first switch TFT SW1, a second switch TFT SW2, and a third switch TFT SW3.

The light emitting diode, for example an organic light emitting diode OLED, includes the anode electrode connected to a source electrode of the driving TFT DT, the cathode electrode connected to the input terminal of a low potential drive voltage EVSS and organic-compound layers located between the anode electrode and the cathode electrode.

The driving TFT DT controls the amount of the current input to the light emitting diode according to the voltage Vgs between a gate electrode and a source electrode. The driving TFT DT is equipped with the gate electrode connected to the first switch TFT SW1, the drain electrode connected to the input terminal of a high potential drive voltage EVDD, and the source electrode connected to the anode electrode of the light emitting diode.

The storage capacitor Cst is connected between the gate node and the source node of the driving TFT DT.

The first switch TFT SW1 applies the data voltage in the data line DATA to the gate node of the driving TFT DT in response to the on-level pulse of a scan signal SCAN(n). The first switch TFT SW1 is equipped with the gate electrode connected to a scan line SCAN, the drain electrode connected to a data line DATA and the source electrode connected to the gate node of the driving TFT DT.

The second switch TFT SW2 applies an initialization voltage Vini to the gate node of the driving TFT DT in response to the on-level pulse of a initialization signal INI(n). The second switch TFT SW2 is equipped with the gate electrode connected to an initialization control line INI, the drain electrode connected to the input terminal of the initialization voltage Vini and the source electrode connected to the gate node of the driving TFT DT.

The third switch TFT SW3 applies a reference voltage Vref to the source node of the driving TFT DT in response to the on-level pulse of a reference signal REF(n). The third switch TFT SW3 is equipped with the gate electrode connected to a reference control line REF, the drain electrode connected to the input terminal of the reference voltage Vref and the source electrode connected to the source node of the driving TFT DT.

In FIGS. 3A to 3E, the TFTs which are operating are indicated by solid lines and the TFTs which are not operating are indicated by dotted lines.

In an initialization period (initial), as shown in FIG. 3A, the scan signal SCAN(n) is of an off-level to turn off the first switch TFT SW1 and the initialization signal INI(n) and the reference signal REF(n) become of an on-level to turn on the second switch TFT SW2 and the third switch TFT SW3, so the initialization voltage Vini is applied to the gate node of the driving TFT DT and the reference voltage Vref is applied to the source node of the driving TFT DT. The initialization period may be one horizontal period 1H.

The voltage corresponding to the difference of the initialization voltage Vini and the reference voltage Vref is charged to the storage capacitor Cst, so the voltage between the gate and the source of the driving TFT DT becomes (Vini-Vref). The initialization voltage Vini is higher than the reference voltage Vref by an amount enough to turn on the driving TFT DT. For example, the initialization voltage Vini may be 4V and the reference voltage Vref may be 1V.

In a heading portion of a threshold voltage sensing period (vth sensing), as shown in FIG. 3B, the scan signal SCAN(n) maintains the off-level to turn off the first switch TFT SW1, the initialization signal INI(n) maintains the on-level to turn on the second switch TFT SW2 which continuously applies the initialization voltage Vini to the gate node of the driving TFT DT, and the reference signal REF(N) changes to the off-level to float the source node of the driving TFT DT.

In the initialization period, the driving TFT DT is turned on by the voltage charged in the storage capacitor Cst. In the threshold voltage sensing period, the voltage of the source node of the driving TFT DT rises toward the voltage of the gate node owing to the current flowing the driving TFT DT (source following), so the voltage of the source of the driving TFT DT rises until the difference between the initialization voltage applied to the gate node of the driving TFT DT and the voltage of the source node corresponds to the threshold voltage Vth of the driving TFT DT if the sensing period is long enough.

In the tail portion of the threshold voltage sensing period (Vth sensing), as shown in FIG. 3C, the scan signal SCAN (n) maintains the off-level to turn off the first switch TFT SW1, the initialization signal INI(n) changes to the off level to turn off the second switch TFT SW2 which floats the gate node of the driving TFT DT, and the reference signal REF(n) maintains the off-level to float the source node of the driving TFT DT.

The driving TFT DT maintains a turn-on state by the voltage charged in the storage capacitor Cst, so the voltage of the source node of the driving TFT DT rises owing to the current flowing the driving TFT DT and the voltage of the gate node of the driving TFT DT rises due to the storage capacitor Cst connected to the source node but rises less than the voltage of the source node rises. Thus, if time continues, the voltage corresponding to the threshold voltage of the driving TFT DT may be charged to the storage capacitor Cst.

In a data writing and mobility sensing period (Writing & μ sensing), as shown in FIG. 3D, the scan signal SCAN(n) changes to the on-level to turn on the first switch TFT SW1 so the data voltage supplied to the data line is applied to the gate node of the driving TFT DT, and the initialization signal INI(n) and the reference signal REF(n) maintain the off-level.

The voltage of the gate node of the driving TFT DT rapidly rise to the data voltage, the current corresponding to the voltage difference between the gate and the source flows the driving TFT DT and the voltage of the source node of the driving TFT DT rises toward the data voltage applied to the gate node of the driving TFT DT, so the voltage difference between the gate and the source of the driving TFT DT are programmed to be a desired gradation level.

That is, when expressing the current flowing the driving TFT DT as $I=K*(Vgs-Vth)^2$, where K is a constant related to the electron mobility and proportional to the electron mobility, in case that the electron mobility of the driving TFT DT is high (K has a high value), the voltage of the source node of the driving TFT DT rapidly rises and Vgs decreases relatively quickly and in case that the electron mobility of the driving TFT DT is small (K has a small value), the voltage of the source node of the driving TFT DT slowly rises and Vgs decreases relatively slowly, such that the current flowing the driving TFT DT becomes irrelevant to the electron mobility and the electron mobility can be compensated.

In an emission period (Emission), as shown in FIG. 3E, the scan signal SCAN(n) changed to the off-level to turn off the first switch TFT SW1, and the initialization signal INI(n) and the reference signal REF(n) maintain the off-level.

The current, corresponding to the potential difference programmed between the gate and the source of the driving TFT DT during the data writing period, that is the potential difference programmed in the storage capacitor Cst, flows. So, the voltage of the source node of the driving TFT DT rises, the voltage of the gate node also rises while maintaining the programmed potential difference and the voltage of the source node becomes higher than the voltage for driving the light emitting diode, which makes the light emitting diode emit light.

As FIG. 4 shows the connections of the control signal lines and the timings of the gate control signals for the pixels of n-th pixel line and (n+1)-the pixel line, each pixel is connected to 3 control signal lines SCAN, REF and INI. The control signal lines provide the control signals to the pixels of the n-the pixel line and the pixels of the (n+1)-th pixel line with the time interval of one horizontal period 1H. In FIG. 4, the scan signal SCAN and the reference control signal REF have a pulse of 1 horizontal period and the initialization control signal INI has a pulse of 3 horizontal periods.

In the present invention, in order to reduce the number of the control signal lines connected to the pixels, the initialization control signal which controls the switch TFT to apply the initialization voltage to the gate node of the driving TFT in the pixel of a previous pixel line may be used as the reference control signal for controlling the switch TFT which is configured to apply the reference voltage to the source node of the driving TFT in the pixel of a current pixel line.

Since the initialization control signal is used as the reference control signal of a next pixel line, and the gate node and the source node should respectively become the initialization voltage and the reference voltage at a same time point in order for the voltage difference between the gate node and the source node of the driving TFT to be higher than a threshold voltage, the initialization controls signal provided to pixel lines should be overlapped with each other at least at a part of the on-level pulse. That is, two initialization control signals respectively provided to adjacent pixel lines have a time difference of 1 horizontal period, so the initialization control signals should be longer than 1 horizontal period to be overlapped with each other.

Figure 5:
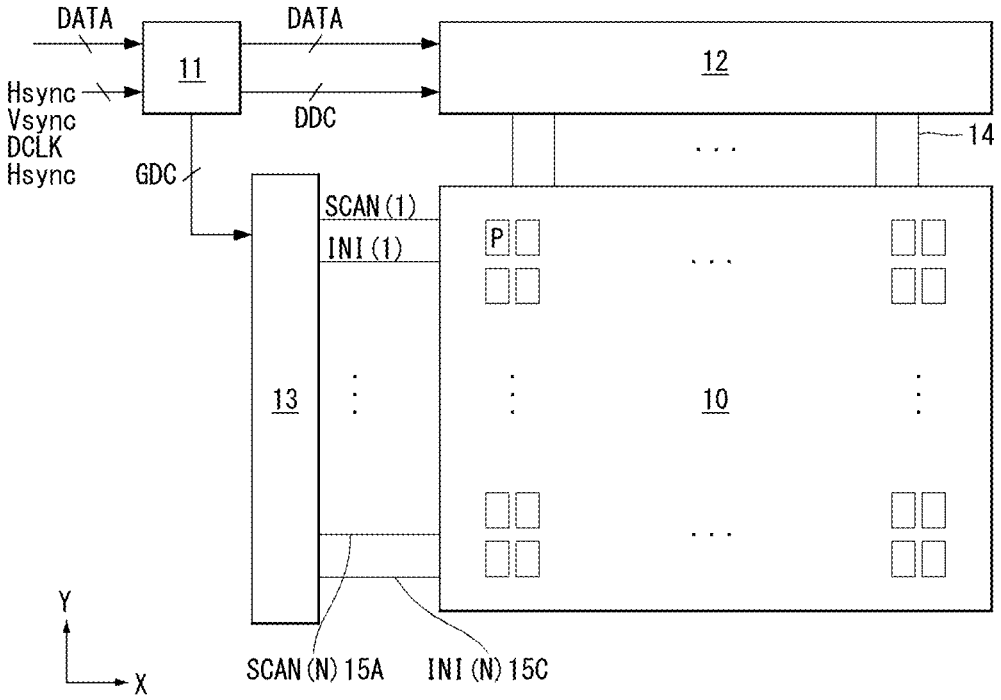
FIG. 5 is a block diagram of a display device according to an embodiment of the present invention.

FIG. 5 is a block diagram of a display device according to an embodiment of the present invention.

The display device according to the present invention comprises a display panel 10, a timing controller 11, a data driving circuit 12 and a gate driving circuit 13.

A plurality of data lines 14 and a plurality of gate lines 15 cross each other on the display panel 10, and the pixels P are arranged in a matrix form to constitute a pixel array. The plurality of gate lines 15 may include a plurality of first gate lines 15A to which a scan signal SCAN is supplied and a plurality of second gate lines 15B to which a initialization control signal INI is supplied.

The pixel P is connected to any one of the data lines 14, any one of the first gate lines 15A, and any one of the second gate lines 15B to constitute a pixel line. The pixel P is electrically connected to the data line 14 in response to the scan pulse input through the first gate line 15A and receives a data voltage. The pixel P receives the initialization voltage and the reference voltage in response to the initialization control pulse input through the second gate line 15B. The pixels disposed in a same pixel line operates simultaneously according to the scan pulse and the initialization pulse applied from a same first gate line 15A and a same second gate line 15B.

The pixel P is supplied with a high potential drive voltage EVDD and a low potential drive voltage EVSS from a not-shown power supply, and may comprise an OLED, a driving TFT, a storage capacitor, a first switch TFT, a second switch TFT and a third switch TFT. The TFTs constituting the pixel P may be implemented as a p-type or an n-type or as a hybrid type in which P-type and N-type are mixed. In addition, the semiconductor layer of the TFTs may include amorphous silicon, polysilicon, or an oxide.

In the driving circuit or the pixel of the present invention, the switch elements may be implemented by the transistor of a n-type Metal Oxide Semiconductor Field Effect Transistor MOSFET or a p-type MOSFET. The following embodiments are illustrated with the n-type transistor, but the present invention is not limited thereto.

A transistor is the element of 3 electrodes including a gate, a source and a drain. The source is an electrode for supplying a carrier to the transistor. Within the transistor the carrier begins to flow from the source. The drain is an electrode from which the carrier exits the transistor. That is, the flow of carriers in the MOSFET is from the source to the drain. In the case of an N-type MOSFET (NMOS), since the carrier is an electron, the source voltage has a voltage lower than the drain voltage so that electrons can flow from the source to the drain. In the N-type MOSFET, a current direction is from the drain to the source because electrons flow from the source to the drain. In the case of a P-type MOSFET (PMOS), since the carrier is a hole, the source voltage is higher than the drain voltage so that holes can flow from the source to the drain. In the P-type MOSFET, a current flows from the source to the drain because holes flow from the source to the drain. It should be noted that the source and drain of the MOSFET are not fixed. For example, the source and drain of the MOSFET may vary depending on the applied voltage. In the following embodiments, the invention should not be limited due to the source and drain of the transistor.

The display device of the present invention adopts an internal compensation scheme. The internal compensation scheme is a technique which drives pixels in a manner of dividing a driving time into an initialization period, a threshold voltage sensing period, a data writing and mobility sensing period and an emitting period and senses and compensates the electrical characteristics of a driving TFT. The electrical characteristics of the driving TFT may include the threshold voltage and the electron mobility of the driving TFT.

The timing controller 11 generates the data control signal DDC for controlling the operation timings of the data driving circuit 12 and the gate control signal GDC for controlling the operation timings of the gate driving circuit 13, based on timing signals, such as a vertical synchronization signal Vsync, a horizontal synchronization signal Hsync, a dot clock signal DCLK, and a data enable signal DE.

The gate control signal GDC includes a gate start pulse GSP, a gate shift clock GSC, a gate output enable signal GOE, and the like. The gate start pulse (GSP) is applied to a gate stage that generates a first scan signal to control the gate stage to generate the first scan signal. The gate shift clock GSC is a clock signal commonly input to the gate stages, and is a clock signal for shifting the gate start pulse GSP. The gate output enable signal GOE is a masking signal that controls the output of the gate stages.

The data control signal DDC includes a source start pulse SSP, a source sampling clock SSC, a source output enable signal SOE, and the like. The source start pulse SSP controls the data sampling start timing of the data driving circuit 12. The source sampling clock SSC is a clock signal that controls the sampling timings of data in respective source drive ICs on the basis of a rising or falling edge. The source output enable signal SOE controls the output timing of the data driving circuit 12.

The data driving circuit 12 may include one or more source drive ICs for dividing and driving the display panel 10 on an area basis. Each source drive IC may include a plurality of digital-to-analog converters DAC connected to the data lines 14. The DAC converts the digital image data RGB input from the timing controller 11 into the data voltage for display according to the data control signal DDC and provides the data voltage to the data lines 14. The data voltage for display is a voltage that varies depending on the gray level of the input image.

The gate drive circuit 13 generates the scan signal SCAN and the initialization control signal INI based on the gate control signal GDC and may comprise a scan driver and a initialization driver separately. The scan driver generates the scan signals SCAN in a row-sequential manner and provides them to the first gate lines 15A connected to pixel lines sequentially, and the initialization driver generates the initialization control signals INI in a row-sequential manner and provides them to the second gate lines 15B connected to the pixel lines sequentially. The pixel line means a set of horizontally adjacent pixels.

The scan signal and the initialization control signal swing between a gate high voltage VGH and a gate low voltage VGL. The gate high voltage VGH is set to a voltage higher than a threshold voltage of a TFT to turn the TFT on, and the gate low voltage VGL is lower than the threshold voltage of the TFT. In the present invention, the initialization control signal INI provided to a pixel line is provided to a next pixel line and used to supply a reference voltage.

The gate drive circuit 13 may be directly formed in a non-display area of the display panel in a Gate-driven In Panel GIP manner.

The OLED display device is mainly described as the display device to which the present invention is applied, but the display device of the present invention is not limited thereto. For example, the display device of the present invention may be applied to an inorganic light emitting display device using an inorganic substance as a light emitting layer, which needs to sense driving characteristics of pixels in order to increase the reliability of the display device.

Figure 6:
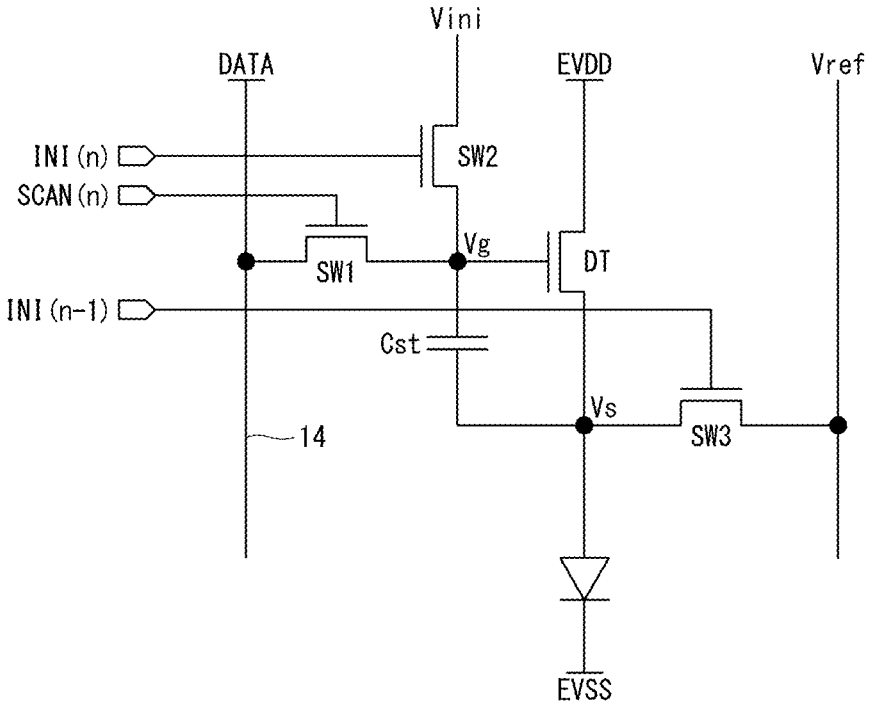
FIG. 6 shows a driving circuit and control signal lines of an organic light emitting pixel according to the present invention, which is composed of four TFTs and one capacitor.
Figure 7:
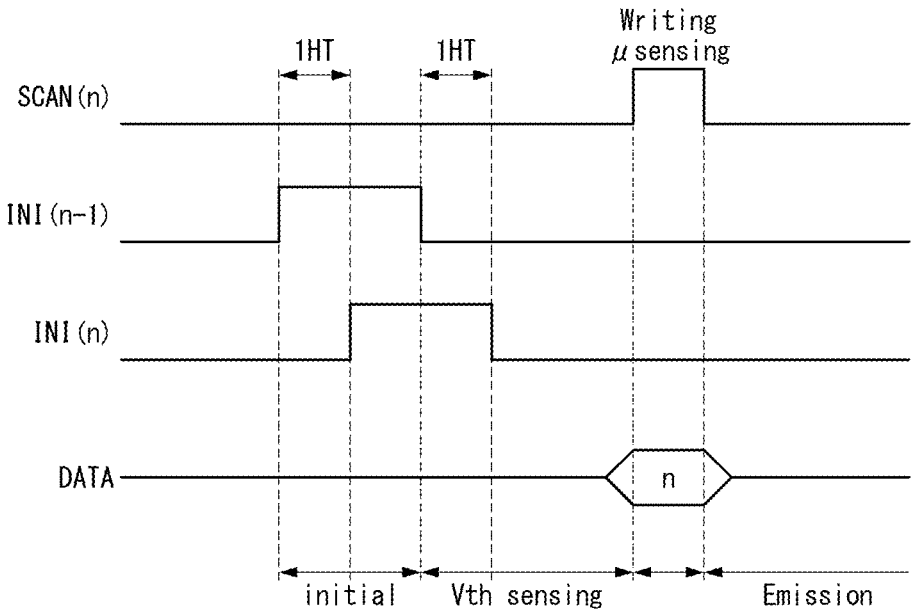
FIG. 7 shows waveforms and timings of control signals for operating the driving circuit of FIG. 6, FIGS. 8A to 8E respectively show the operations of the driving circuit of FIG. 6 during the corresponding periods in the timings of FIG. 7.
Figure 8A:
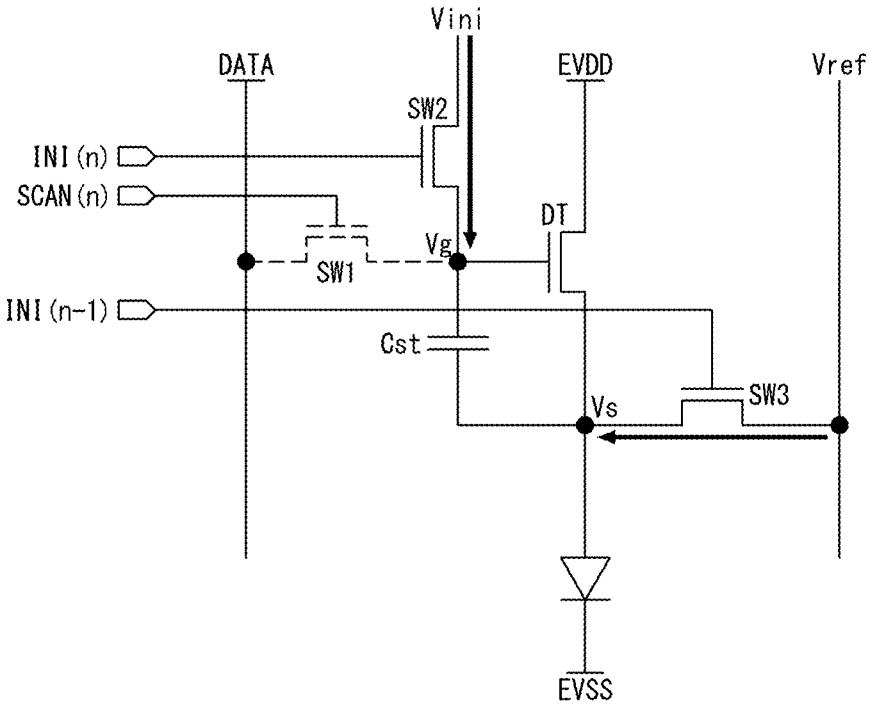
Figure 8B:
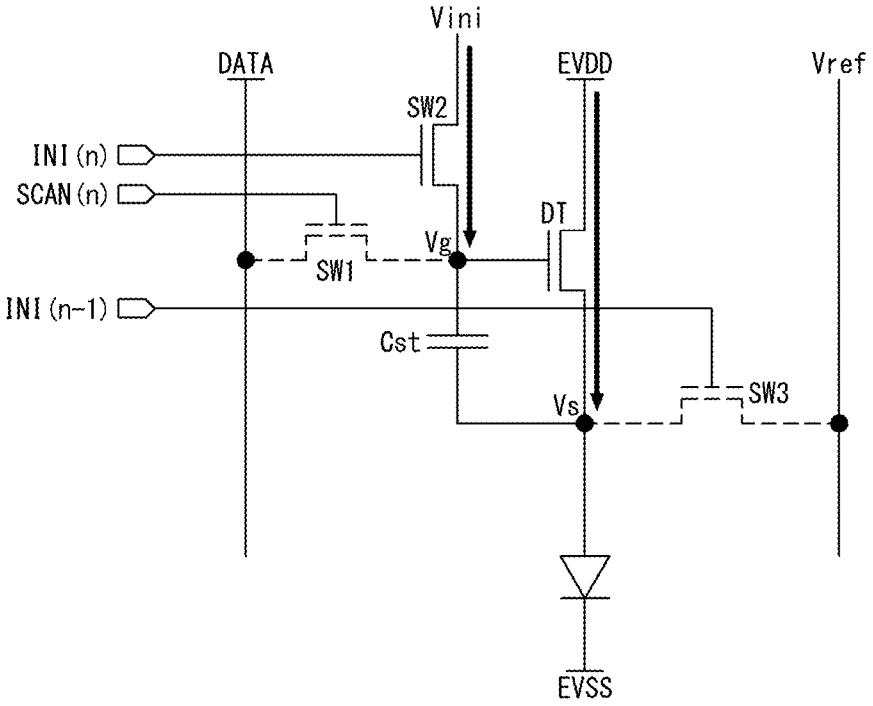
Figure 8C:
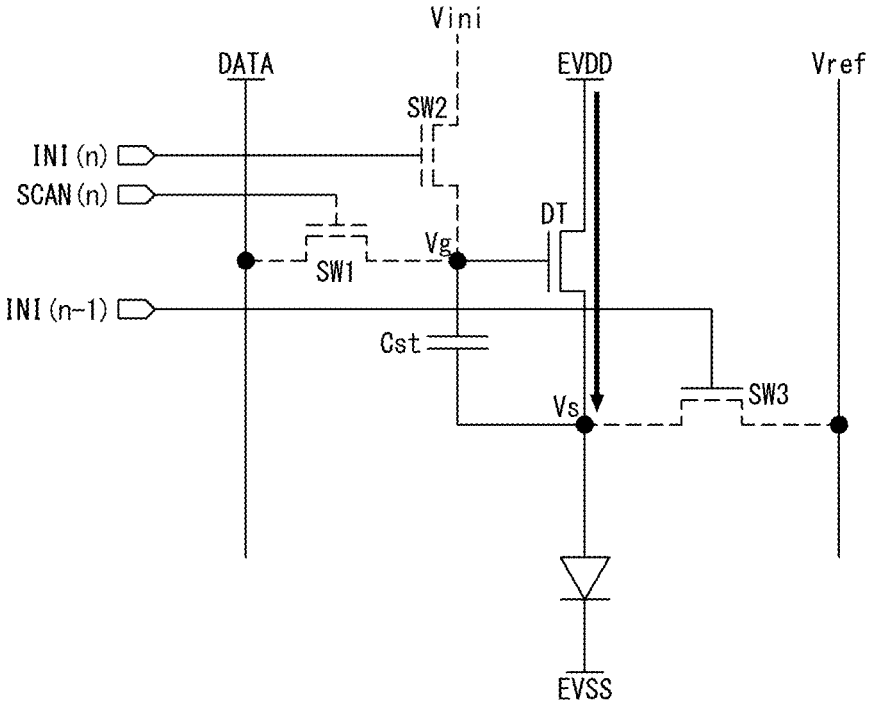
Figure 8D:
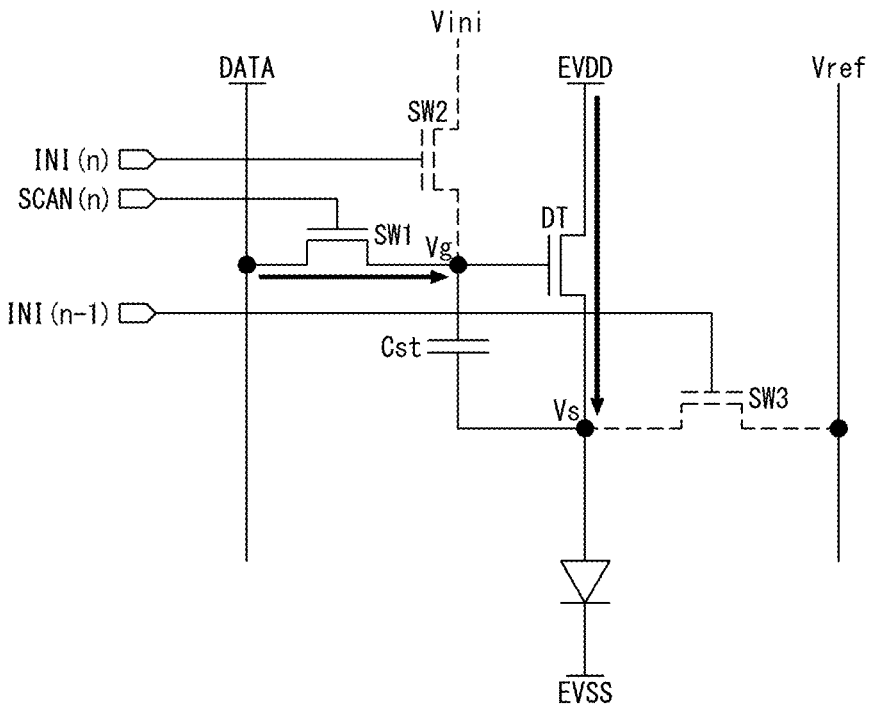
Figure 8E:
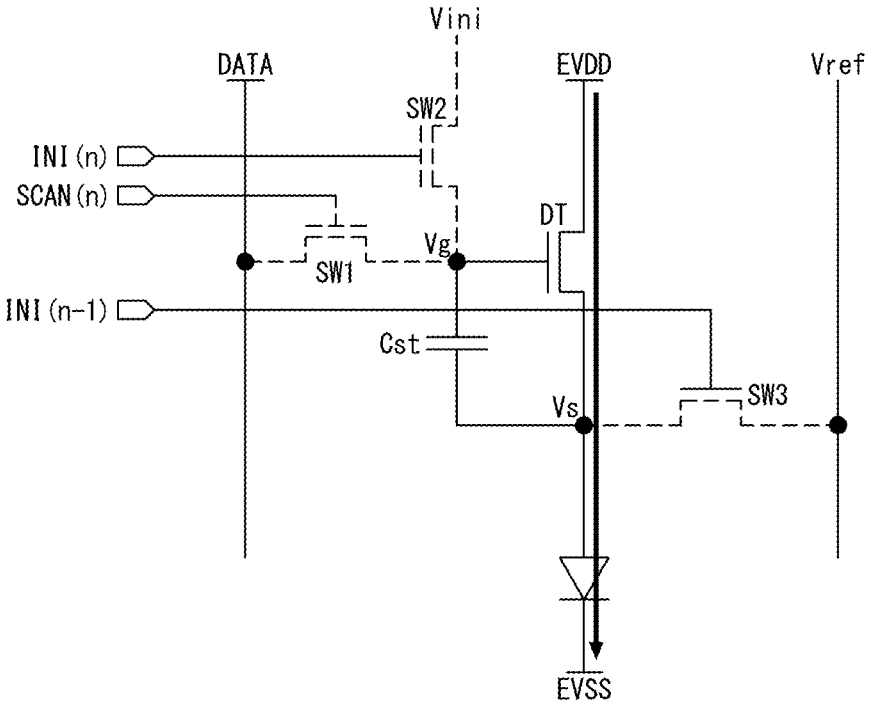
Figure 9:
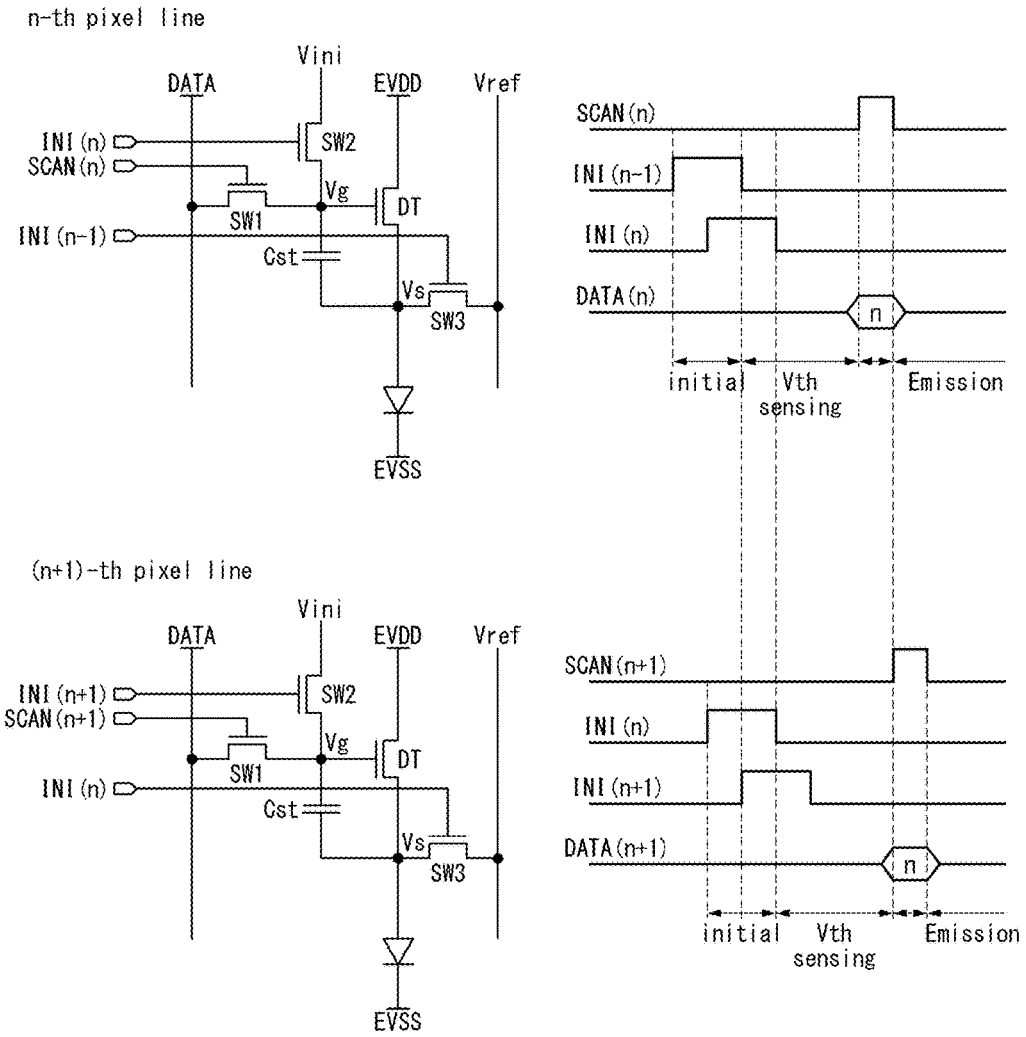
FIG. 9 illustrates a driving circuit and control signals of two consecutive pixel lines according to an embodiment of the present invention.
Figure 10:
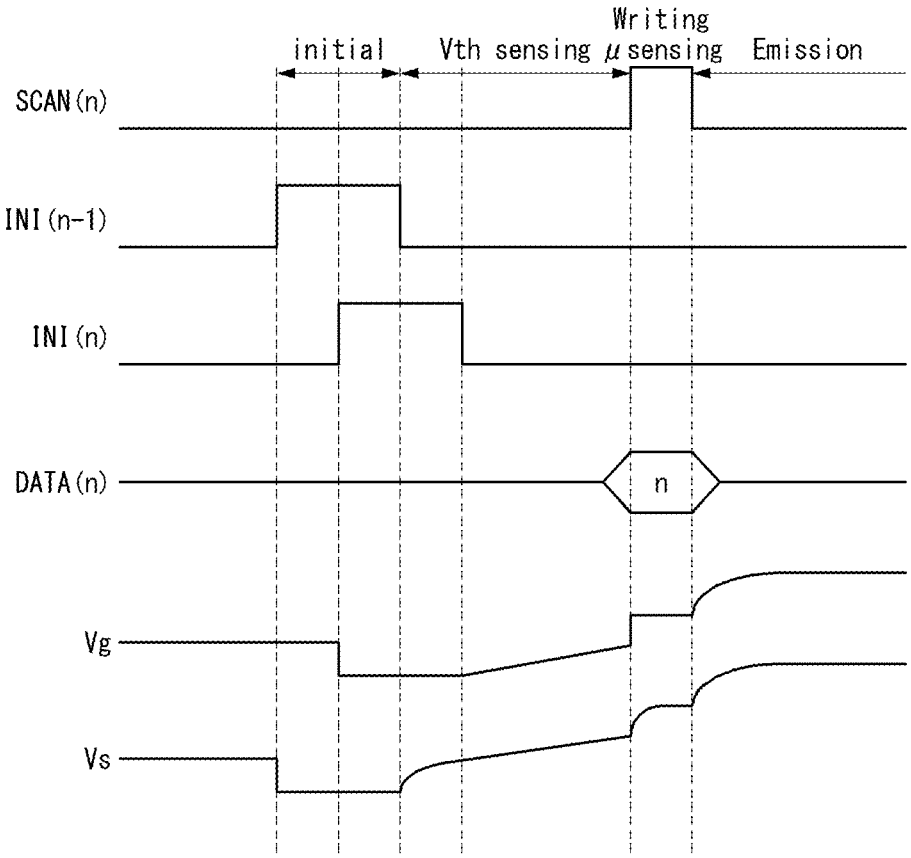
FIG. 10 shows waveforms and timings of control signals and output signals in the driving circuit of FIG. 6.

FIG. 6 shows a driving circuit and control signal lines of an organic light emitting pixel according to the present invention, which is composed of four TFTs and one capacitor, FIG. 7 shows waveforms and timings of control signals for operating the driving circuit of FIG. 6, FIGS. 8A to 8E respectively show the operations of the driving circuit of FIG. 6 during the corresponding periods in the timings of FIG. 7, FIG. 9 illustrates a driving circuit and control signals of two consecutive pixel lines according to an embodiment of the present invention, and FIG. 10 shows waveforms and timings of control signals and output signals in the driving circuit of FIG. 6.

In FIG. 6, the pixel (pixel of n-th pixel line) including the driving circuit for compensating the threshold voltage and the electron mobility of a driving TFT comprises a light emitting diode, a driving TFT DT, a storage capacitor Cst, a first switch TFT SW1, a second switch TFT SW2 and a third switch TFT SW3 as same as FIG. 1.

The light emitting diode, for example OLED, includes an anode electrode connected to the source node of the driving TFT DT, an cathode electrode connected to the input terminal of a low potential drive voltage EVSS and organic compound layers located between the anode electrode and the cathode electrode.

The driving TFT DT controls the amount of the current input to the light emitting diode according to the voltage Vgs between a gate electrode and a source electrode. The gate electrode of the driving TFT DT is connected to the first switch TFT SW1, the drain electrode of the driving TFT DT is connected to the input terminal of a high potential drive voltage EVDD, and the source electrode of the driving TFT DT is connected to the anode electrode of the light emitting diode.

The storage capacitor Cst is connected between the gate node and the source node of the driving TFT DT.

The first switch TFT SW1 applies the data voltage in the data line DATA to the gate node of the driving TFT DT in response to the on-level pulse of a scan signal SCAN(n). The gate electrode of the first switch TFT SW1 is connected to a scan line SCAN, the drain electrode of the first switch TFT SW1 is connected to a data line DATA and the source electrode of the first switch TFT SW1 is connected to the gate node of the driving TFT DT.

The second switch TFT SW2 applies an initialization voltage Vini to the gate node of the driving TFT DT in response to the on-level pulse of a initialization signal INI(n). The gate electrode of the second switch TFT SW2 is connected to an initialization control line INI, the drain electrode of the second switch TFT SW2 is connected to the input terminal of the initialization voltage Vini and the source electrode of the second switch TFT SW2 is connected to the gate node of the driving TFT DT.

The third switch TFT SW3 applies a reference voltage Vref to the source node of the driving TFT DT in response to the on-level pulse of a initialization signal INI(n−1) applied to the pixels ((n−1)-th pixel) located in a previous pixel line. The gate electrode of the third switch TFT SW3 is connected to the initialization control line INI connected to a (n−1)-th pixel, the drain electrode of the third switch TFT SW3 is connected to the input terminal of the reference voltage Vref and the source electrode of the third switch TFT SW3 is connected to the source node of the driving TFT DT.

As shown in FIG. 7, a pixel driving is divided into an initialization period (initial), a threshold voltage sensing period (Vth sensing), a data writing and mobility sensing period (Writing & μ sensing) and an emission period (Emission). In FIG. 7, the on-level pulse of the initialization signal INI has 2 horizontal period, so the initialization signal INI(n−1) of a previous pixel line and the initialization signal INI(n) of a current pixel line are overlapped with each other in their on-level pulses during 1 horizontal period. The pulse of the initialization signal INI(n) is applied, and then after a predetermined time has lapsed the on-level pulse of a scan signal SCAN(n) is provided.

In FIGS. 8A to 8E, the TFTs which is operating are indicated by solid lines and the TFTs which is not operating are indicated by dotted lines.

The initialization period is the period during which the initialization signal INI(n−1) of a previous pixel line provides an on-level pulse. The initialization period extends until a time point when the initialization signal INI(n−1) of the previous pixel line transits from the on-level to an off-level while the initialization signal INI(n) of a current pixel line maintains the on-level. The threshold voltage sensing period is the period from a time point when the initialization signal INI(n−1) of the previous pixel line transits to the off-level to a time point just before a scan signal SCAN(n) provides an on-level pulse, in a state that the initialization signal INI(n) of the current pixel line maintains the on-level. The data writing and mobility sensing period is the period during which the scan signal SCAN(n) maintains the on-level. The emission period starts from a time point when the scan signal SCAN(n) transits from the on-level to an off-level.

When the initialization signal INI(n−1) of the previous pixel line is the on-level and the initialization signal INI(n) of the current pixel line is the off-level among the initialization period, the source node of the driving TFT DT is initialized to a reference voltage Vref and the gate node of the driving TFT DT maintains a previous voltage. The scan signal SCAN(n) is the off-level so the first switch TFT SW1 is turned off. The second switch TFT SW2 is turned off by the off-level of the initialization signal INI(n). The third switch TFT SW3 is turned on by the on-level of the initialization signal INI(n−1).

When the initialization signal INI(n−1) of the previous pixel line and the initialization signal INI(n) of the current pixel line are both the on-level among the initialization period, as shown in FIG. 8A, the second and third switch TFTs SW2 and SW3 are turned on, so the gate node and the source node of the driving TFT DT are respectively initialized to the initialization voltage Vini and the reference voltage Vref.

The voltage corresponding to the difference of the initialization voltage Vini and the reference voltage Vref is charged to the storage capacitor Cst, so the voltage between the gate and the source of the driving TFT DT becomes (Vini−Vref). The initialization voltage Vini is higher than the reference voltage Vref by an amount enough to turn on the driving TFT DT, for example the initialization voltage Vini is 4V and the reference voltage Vref is 1V, so the driving TFT DT becomes a state of being turned on.

As shown in FIG. 8B, when the initialization signal INI(n−1) becomes the off-level and the initialization signal INI(n) is the on-level among the threshold voltage sensing period, the second switch TFT SW2 maintains a turn-on state to continuously apply the initialization voltage Vini to the gate node of the driving TFT DT, and the third switch TFT SW3 is turned off to float the source node of the driving TFT DT.

At this time, the driving TFT DT is turned on and a current flows the driving TFT DT owing to the voltage difference, between the gate node and the source node, which is higher than the threshold voltage of the driving TFT DT, so the voltage of the source node rises toward the initialization voltage of the gate node. If a time is long enough, the voltage close to the threshold voltage of the driving TFT DT is charged to the storage capacitor Cst.

However, as shown in FIG. 7, since the duration, during which the initialization signal INI(n−1 is the off-level and the initialization signal INI(n) is the on-level, is as short as 1 horizontal period among the threshold voltage sensing period, the voltage of the source node rises to a value smaller than the value (Vini−Vth) obtained by subtracting the threshold voltage Vth from the voltage of gate node Vini, and a voltage higher than the threshold voltage is charged to the storage capacitor Cst.

When both of the initialization signals INI(n−1) and INI(n) are the off-level among the threshold voltage sensing period, as shown in FIG. 8C, both of the second and third switch TFTs SW2 and SW3 are turned off to float the gate and source nodes of the driving TFT DT.

At this time, the driving TFT DT maintains the turn-on state and a current flows the driving TFT DT owing to the voltage (higher than the threshold voltage of the driving TFT DT) charged to the storage capacitor Cst, so the voltage of the source node rises and the voltage of the gate node also rises due to the storage capacitor Cst. But, the voltage of the gate node rises less than the voltage of the source node rises, so a voltage close to the threshold voltage is charged to the storage capacitor Cst.

As shown in FIG. 8D, during the data writing and mobility sensing period, the scan signal SCAN(n) becomes the on-level to turn on the first switch TFT SW1, the data voltage written in a data line is applied to the gate node of the driving TFT DT and the voltage of the gate node of the driving TFT DT rapidly rises. The driving TFT DT maintains the turn-on state and a current flow the driving TFT DT owing to the voltage charged to the storage capacitor Cst, so the voltage of the source node rises toward the voltage of the gate node at a speed proportional to the electron mobility of the driving TFT DT.

As described above, when expressing the current flowing the driving TFT DT as $I=K*(Vgs-Vth)^2$, where K is a constant related to the electron mobility and proportional to the electron mobility, in case that the electron mobility of the driving TFT DT is high (K has a high value), the voltage of the source node of the driving TFT DT rapidly rises and Vgs decreases relatively quickly and in case that the electron mobility of the driving TFT DT is small (K has a small value), the voltage of the source node of the driving TFT DT slowly rises and Vgs decreases relatively slowly. That is, since the varying speeds of K and $(Vgs-Vth)^2$ have an inverse relation with each other in terms of the electron mobility. the current flowing the driving TFT DT becomes irrelevant to the electron mobility and the electron mobility can be compensated.

As shown in FIG. 8E, during the emission period, the scan signal SCAN(n) changes to the off-level to turn off the first switch TFT SW1, and the current, corresponding to the potential difference programmed between the gate and the source of the driving TFT DT during the data writing period, that is the potential difference programmed in the storage capacitor Cst, flows. So, the voltage of the source node of the driving TFT DT rises, the voltage of the gate node also rises while maintaining the programmed potential difference and the voltage of the source node becomes higher than the voltage for driving the light emitting diode, which makes the light emitting diode emit light.

As shown in FIG. 9, the control signals applied to the pixels in n-th pixel line are later than the control signals applied to the pixels in (n−1)-th pixel line by 1 horizontal period 1H. 3 control signals are supplied to each pixel, and one control signal applied to a corresponding pixel in a previous pixel line is used. In FIG. 9, in order to initialize the source node of the driving TFT DT equipped in a pixel disposed in (n+1)-th pixel line, the initialization control signal INI(n) which is the control signal for initializing the gate node of the driving TFT DT of a corresponding pixel disposed in n-th pixel line is used.

Figure 11:
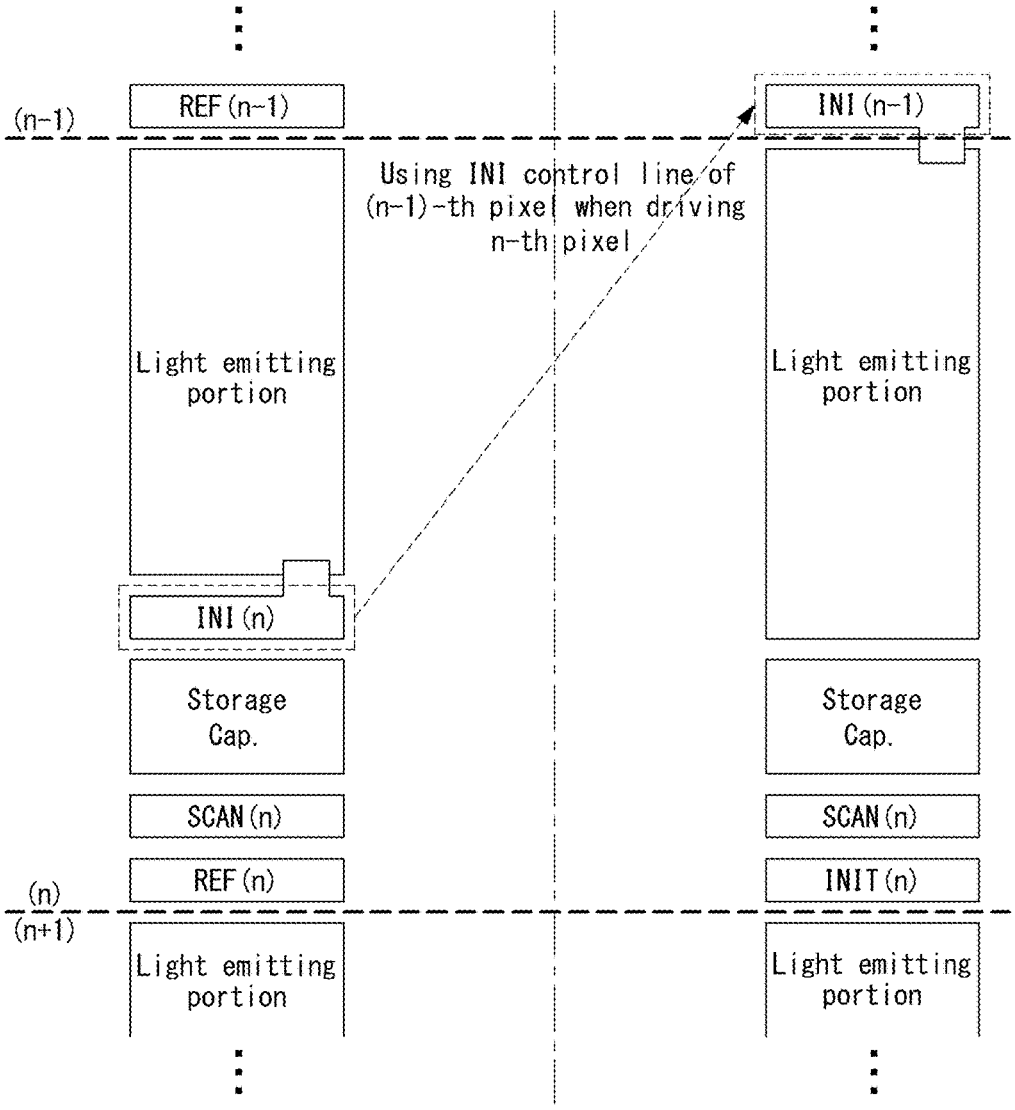
FIG. 11 is the plan views of the organic light emitting pixel of FIG. 1 and the organic light emitting pixel of FIG. 6 according to an embodiment of the present invention.

FIG. 11 is the plan views of the organic light emitting pixel of FIG. 1 and the organic light emitting pixel of FIG. 6 according to an embodiment of the present invention. The left side of FIG. 11 is a plan view of the organic light emitting pixel of FIG. 1 and the right side is a plan view of the organic light emitting pixel of FIG. 6.

In the left plan view 3 control signal lines SCAN, INI and REF are connected to each pixel line. In the right plan view 2 control signal lines SCAN and INI are connected to each pixel line, and the pixel in n-th pixel line uses the initialization control signal from the initialization control line INI(n−1) connected to a corresponding pixel in (n−1)-th pixel line. In FIG. 11, the third switch TFT SW3 using the initialization control line INI(n−1) may be disposed in a corresponding pixel in a previous pixel line (n−1).

In the left plan view, one control signal line among the control signal lines passes in a horizontal direction near the center of a pixel, so the aperture ratio is low. In the right plan view, the control signal lines are arranged between two adjacent pixel lines, so the aperture ratio can be increased. The aperture ratio of the right plan view is higher than that of the left plan view by about 4%.

Also, the control signal lines are uniformly arranged and the interval between the light emitting portions is made constant, so it is possible to suppress a moiré phenomenon or the like which occurs when the openings are irregularly arranged for each pixel line.

Figure 12:
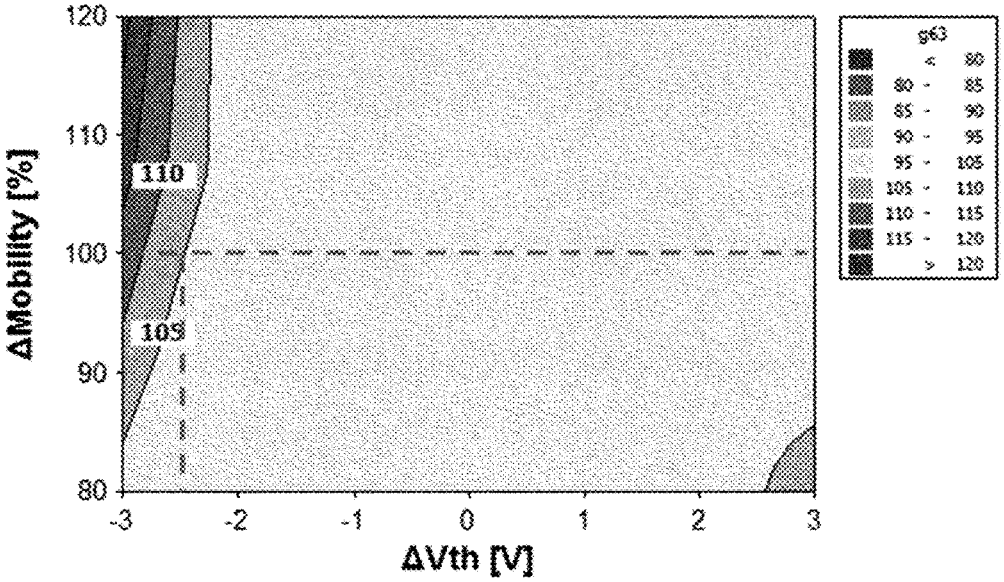
FIG. 12 shows a variation range of the threshold voltages and the electron mobility which are allowed to constantly control the current applied to the pixel within a predetermined range.

FIG. 12 shows a variation range of the threshold voltages and the electron mobility which are allowed to constantly control the current applied to the pixel within a predetermined range.

The characteristics of the driving TFT DT vary from pixel to pixel, and the characteristics of the driving TFT DT vary with time. However, in spite of this characteristic variations the fluctuating amount of a flowing current should be within a predetermined range, for example, within 5%.

While independently varying the threshold voltage of the driving TFT DT (−3V to 3V range) and the electron mobility of the driving TFT DT (±20%, ie, 80% to 120% range), the changes of the current flowing through the driving TFT DT are simulated. As shown in FIG. 12, the pixel driving circuit of the present invention can suppress the fluctuation amount of the current to 5% or less even though the threshold voltage varies from −2.5V to 3.0V and the electron mobility varies from 80% to 120%.

Therefore, in the driving circuit of the present invention, even if the characteristics of the driving TFT (DT) constituting the pixel circuit are changed, the current can be adjusted to a desired value without greatly changing the amount of a flowing current.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel equipped with a plurality of pixels connected with data lines and gate lines;

a data driving circuit configured to provide data voltage to the pixels through the data lines; and a gate driving circuit configured to drive the gate lines, wherein a first pixel disposed in n-th pixel line among the plurality of pixels, n being a natural number, comprises:

a light emitting diode;

a driving TFT, whose source is connected to the light emitting diode, configured to control a current flowing the light emitting diode;

a capacitor connecting the source of the driving TFT and a gate of the driving TFT;

a first TFT configured to be controlled by a first gate signal which is transferred through a first gate line and generated by the gate driving circuit to connect the gate of the driving TFT to one of the data lines;

a second TFT configured to be controlled by a second gate signal which is transferred through a second gate line and generated by the gate driving circuit to connect the gate of the driving TFT to an initialization voltage; and a third TFT configured to be controlled by the second gate signal transferred to a second pixel disposed in (n−1)-th pixel line to connect the source of the driving TFT to a reference voltage, wherein, in a first portion of a threshold voltage sensing period, a voltage of the source of the driving thin film transistor is configured to rise to a value smaller than a value obtained by subtracting a threshold voltage of the driving thin film transistor from a voltage of the gate of the driving thin film transistor, such that a voltage higher than the threshold voltage is charged to the capacitor, and wherein, in a second portion of the threshold voltage sensing period, the voltage of the source is configured to rise and the voltage of the gate is configured to rise due to the capacitor, wherein the voltage of the gate is configured to rise less than the voltage of the source is configured to rise such that a voltage close to the threshold voltage is charged to the capacitor.

2. The display device of claim 1, wherein the second gate signal transferred to the second pixel in the (n−1)-th pixel line and the second gate signal transferred to the first pixel in the n-th pixel line are overlapped with each other for a part of a on-level pulse of turning on a TFT.

3. The display device of claim 2, wherein the gate driving circuit is configured to output the on-level pulse having 2 horizontal periods to the second gate line as the second gate signal.

4. The display device of claim 2, wherein the gate driving circuit is configured to output the on-level pulse to the second gate line of the first pixel in the n-th pixel line as the second gate signal, and then after a predetermined period of time has elapsed the gate driving circuit is configured to output the on-level pulse having one horizontal period to the first gate line of the first pixel in the n-th pixel line as the first gate signal and the data driving circuit is configured to apply the data voltage to the data line in synchronization with the first gate signal.

5. The display device of claim 1, wherein the reference voltage is lower than the initialization voltage enough to turn on the driving TFT and lower than a voltage that turns on the light emitting diode.

6. A method of driving a display device which comprises a plurality of pixels each of which includes a light emitting diode, a driving TFT whose source is connected to the light emitting diode, a capacitor connecting the source of the driving TFT and a gate of the driving TFT, a first TFT to connect the gate of the driving TFT to one of data lines, a second TFT to connect the gate of the driving TFT to an initialization voltage, and a third TFT to connect the source of the driving TFT to a reference voltage, the method comprising:

generating a first initialization signal having an on-level pulse which turns on a TFT and applying the first initialization signal to a gate of the second TFT of a first pixel disposed in a (n−1)-th pixel line and a gate of the third TFT of a second pixel disposed in a n-th pixel line, n being a natural number;

generating a second initialization signal having the on-level pulse and applying the second initialization signal to a gate of the second TFT of the first pixel and a gate of the third TFT of a third pixel disposed in a (n+1)-th pixel line; and generating and applying a scan signal having the on-level pulse to a gate of the first TFT of the second pixel and applying a data voltage for the second pixel to the data line, wherein, in a first portion of a threshold voltage sensing period, a voltage of the source of the driving thin film transistor is configured to rise to a value smaller than a value obtained by subtracting a threshold voltage of the driving thin film transistor from a voltage of the gate of the driving thin film transistor, such that a voltage higher than the threshold voltage is charged to the capacitor, and wherein, in a second portion of the threshold voltage sensing period, the voltage of the source is configured to rise and the voltage of the gate is configured to rise due to the capacitor, wherein the voltage of the gate is configured to rise less than the voltage of the source is configured to rise such that a voltage close to the threshold voltage is charged to the capacitor.

7. The method of claim 6, wherein the first and second initialization signals are overlapped with each other for a part of the on-level pulse.

8. The method of claim 7, wherein the on-level pulses of the first and second initialization signals have 2 horizontal periods.

9. The method of claim 6, wherein the pulse of the second initialization signal is generated and then after a predetermined period of time has elapsed a pulse of a scan signal having one horizontal period is generated.

* * * * *